US010360842B2

(12) United States Patent
Hwang et al.

(10) Patent No.: US 10,360,842 B2
(45) Date of Patent: Jul. 23, 2019

(54) VIDEO SIGNAL CONDITIONER OF DISPLAY DEVICE AND VIDEO SIGNAL ADJUSTMENT METHOD THEREOF

(71) Applicant: Shenzhen China Star Optoelectronics Semiconductor Display Technology Co., Ltd., Shenzhen, Guangdong (CN)

(72) Inventors: Tai-Jiun Hwang, Guangdong (CN); Yuchao Zeng, Guangdong (CN)

(73) Assignee: Shenzhen China Star Optoelectronics Semiconductor Display Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 15/573,143

(22) PCT Filed: Jun. 14, 2017

(86) PCT No.: PCT/CN2017/088184

§ 371 (c)(1),
(2) Date: Nov. 10, 2017

(87) PCT Pub. No.: WO2018/201559

PCT Pub. Date: Nov. 8, 2018

(65) Prior Publication Data

US 2018/0357947 A1 Dec. 13, 2018

(51) Int. Cl.

| | |
|---|---|
| ***G09G 3/20*** | (2006.01) |
| ***G09G 3/3225*** | (2016.01) |
| ***G09G 3/3208*** | (2016.01) |

(52) U.S. Cl.

CPC ..... *G09G 3/2096* (2013.01); *G09G 3/3208* (2013.01); *G09G 3/3225* (2013.01);
(Continued)

(58) Field of Classification Search

CPC ..... G09G 3/2096; G09G 3/3208; G09G 2320/043; G09G 2320/0295; G09G 2320/0646

See application file for complete search history.

(56) References Cited

U.S. PATENT DOCUMENTS

2009/0219379 A1* 9/2009 Rossato ..... H04N 5/272 348/14.01
2010/0253711 A1* 10/2010 Muroi ..... G02F 1/133603 345/690

(Continued)

*Primary Examiner* — Maurice L. McDowell, Jr.
*Assistant Examiner* — Donna J. Ricks
(74) *Attorney, Agent, or Firm* — Andrew C. Cheng

(57) ABSTRACT

A video signal conditioner of a display device is provided. The video signal conditioner includes: a signal receiving module, for receiving an externally input video signal; a luminance conversion module, for converting the externally input video signal to brightness; an average luminance acquiring module, for acquiring an average luminance of a Nth row of pixels when a Mth frame image is displayed; a luminance adjustment parameter calculation module, for calculating a luminance adjustment parameter of the Nth row of pixels when the Mth frame image is displayed; a video signal adjustment parameter calculation module, for calculating a video signal adjustment parameter of the Nth row of pixels when the Mth frame image is displayed; an output module, for outputting the adjusted video signal corresponding to the Nth line of pixels when the Mth frame image is displayed.

6 Claims, 2 Drawing Sheets

(52) U.S. Cl.
CPC ..... *G09G 2320/0295* (2013.01); *G09G 2320/043* (2013.01); *G09G 2320/0626* (2013.01); *G09G 2320/0646* (2013.01); *G09G 2360/16* (2013.01)

(56) References Cited

U.S. PATENT DOCUMENTS

2014/0253764 A1* 9/2014 Haas ..... H04N 5/361
348/243
2016/0037061 A1* 2/2016 Lim ..... H04N 5/23229
348/241

* cited by examiner

VIDEO SIGNAL CONDITIONER OF DISPLAY DEVICE AND VIDEO SIGNAL ADJUSTMENT METHOD THEREOF

FIELD OF THE INVENTION

The present disclosure belongs to a technical field of signal processing, and particularly relates to a video signal conditioner of display device and a video signal adjustment method thereof.

BACKGROUND OF THE INVENTION

An AMOLED (Active Matrix Organic Light Emitting Diode) display device is widely used because of its wider viewing angle, higher refresh rate and thinner thickness.

In the AMOLED display device, the aging of TFT devices and OLED devices is positively correlated with the drive current, and the power drive capability is also positively correlated with the drive current. Therefore, when the drive current is higher, the aging of TFT and OLED devices is faster, and the cost of power is higher. Thus, it will shorten the life of AMOLED display device and increase the cost of the AMOLED display device.

SUMMARY OF THE INVENTION

In order to solve the above-mentioned problems of the current technology, the object of the present disclosure is to provide a video signal conditioner and a video signal adjustment method which can control the OLED aging speed and the cost of a display device.

According to an aspect of the present disclosure, this disclosure provides a video signal conditioner of a display device. The video signal conditioner comprises: a signal receiving module, for receiving an externally input video signal; a luminance conversion module, for converting the externally input video signal to brightness; an average luminance acquiring module, for acquiring an average luminance of a Nth row of pixels when a Mth frame image is displayed; a luminance adjustment parameter calculation module, for calculating a luminance adjustment parameter of the Nth row of pixels when the Mth frame image is displayed according to the average luminance of the Nth row of pixels when the Mth frame image is displayed, the average luminance of the Nth row of pixels when a M−1th frame image is displayed, and the luminance adjustment parameter of a N−1th row pixel when the Mth frame image is displayed; a video signal adjustment parameter calculation module, for calculating a video signal adjustment parameter of the Nth row of pixels when the Mth frame image is displayed according to the luminance adjustment parameter of the Nth row of pixels when the Mth frame image is displayed, a first preset luminance adjustment parameter, and a second preset luminance adjustment parameter; an output module, for adjusting an externally input video signal corresponding to the Nth row of pixels when the Mth frame image is displayed according to the video signal adjustment parameter of the Nth row of pixels when the Mth frame image is displayed, and outputting the adjusted video signal corresponding to the Nth line of pixels when the Mth frame image is displayed Preferably, the luminance adjustment parameter calculation module further uses the following formula 1 to calculate the luminance adjustment parameter of the Nth row of pixels when the Mth frame image is displayed according to the average luminance of the Nth row of pixels when the Mth frame image is displayed, the average luminance of the Nth row of pixels when the M−1th frame image is displayed, and the luminance adjustment parameter of the N−1th row pixel when the Mth frame image is displayed.

$$CL_N = CL_{N-1} + (AL_N - AL'_N)/N \quad \text{[formula 1]}$$

Wherein $AL_N$ represents the average luminance of the Nth row of pixels when the Mth frame image is displayed, $AL'_N$ represents the average luminance of the Nth row of pixels when the M−1th frame image is displayed, $CL_{N-1}$ represents the luminance adjustment parameter of the N−1th row of pixels when the Mth frame image is displayed, and $CL_N$ represents the luminance adjustment parameter of the Nth row of pixels when the Mth frame image is displayed.

Preferably, the video signal adjustment parameter calculation module further uses the following formula 2 to calculate the video signal adjustment parameter of the Nth row of pixels when the Mth frame image is displayed according to the luminance adjustment parameter of the Nth row of pixels when the Mth frame image is displayed, the first preset luminance adjustment parameter, and the second preset luminance adjustment parameter.

$$r_N = \begin{cases} r_1 & CL_N \le CL_{th1} \\ r_1 - \dfrac{(r_1 - r_2)(CL_N - CL_{th1})}{CL_{th2} - CL_{th1}} & CL_{th1} < CL_N \le CL_{th2} \end{cases} \quad \text{[formula 2]}$$

Wherein $CL_N$ represents the luminance adjustment parameter of the Nth row of pixels when the Mth frame image is displayed, $CL_{th1}$ represents the first preset luminance adjustment parameter, $CL_{th2}$ represents the second preset luminance adjustment parameter, $r_N$ represents the video signal adjustment parameter of the Nth row of pixels when the Mth frame image is displayed, $r_1$ and $r_2$ respectively represent two different fixed values.

Preferably, the output module further uses the following formula 3 to adjust the externally input video signal corresponding to the Nth row of pixels when the Mth frame image is displayed according to the video signal adjustment parameter of the Nth row of pixels when the Mth frame image is displayed.

$$D_{outN} = D_{inN} * r_N \quad \text{[formula 3]}$$

Wherein $D_{outN}$ represents the adjusted video signal corresponding to the Nth row of pixels when the Mth frame image is displayed, $D_{inN}$ represents the video signal corresponding to the externally input Nth row of pixels when the Mth frame image is displayed, and $r_N$ represents the video signal adjustment parameter of the Nth row of pixels when the Mth frame image is displayed.

Preferably, the luminance conversion module is further for converting the externally input video signal to a HSV color space to perceive brightness.

According to another aspect of the present disclosure, this disclosure also provides a video signal adjustment method of a display device. The video signal adjustment method comprises: receiving the externally input video signal; converting the externally input video signal to brightness; acquiring the average luminance of the Nth row of pixels when the Mth frame image is displayed; calculating the luminance adjustment parameter of the Nth row of pixels when the Mth frame image is displayed, according to the average luminance of the Nth row of pixels when the Mth frame image is displayed, the average luminance of the Nth row of pixels when the M−1th frame image is displayed, and the luminance adjustment parameter of the N−1th row pixel when the Mth frame image is displayed; calculating a video signal adjustment parameter of the Nth row of pixels when the Mth frame image is displayed, according to the luminance adjustment parameter of the Nth row of pixels when the Mth frame image is displayed, a first preset luminance adjustment parameter, and a second preset luminance adjustment parameter; adjusting an externally input video signal corresponding to the Nth row of pixels when the Mth frame image is displayed according to the video signal adjustment parameter of the Nth row of pixels when the Mth frame image is displayed, and outputting the adjusted video signal corresponding to the Nth line of pixels when the M frame image is displayed.

Preferably, in the video signal adjustment method of the display device, the luminance adjustment parameter of the Nth row of pixels when the Mth frame image being displayed is calculated by the following formula 1, according to the average luminance of the Nth row of pixels when the Mth frame image is displayed, the average luminance of the Nth row of pixels when the M−1th frame image is displayed, and the luminance adjustment parameter of the N−1th row pixel when the Mth frame image is displayed.

$$CL_N=CL_{N-1}+(AL_N-AL'_N)/N \quad \text{[formula 1]}$$

Wherein $AL_N$ represents the average luminance of the Nth row of pixels when the Mth frame image is displayed, $AL'_N$ represents the average luminance of the Nth row of pixels when the M−1th frame image is displayed, $CL_{N-1}$ represents the luminance adjustment parameter of the N−1th row of pixels when the Mth frame image is displayed, and $CL_N$ represents the luminance adjustment parameter of the Nth row of pixels when the Mth frame image is displayed.

Preferably, in the video signal adjustment method of the display device, the video signal adjustment parameter of the Nth row of pixels when the Mth frame image being displayed is acquired by the following formula 2, according to the luminance adjustment parameter of the Nth row of pixels when the Mth frame image is displayed, a first preset luminance adjustment parameter, and a second preset luminance adjustment parameter.

$$r_N=\begin{cases} r_1 & CL_N \le CL_{th1} \\ r_1-\dfrac{(r_1-r_2)(CL_N-CL_{th1})}{CL_{th2}-CL_{th1}} & CL_{th1}<CL_N\le CL_{th2} \end{cases} \quad \text{[formula 2]}$$

Wherein $CL_N$ represents the luminance adjustment parameter of the Nth row of pixels when the Mth frame image is displayed, $CL_{th1}$ represents the first preset luminance adjustment parameter, $CL_{th2}$ represents the second preset luminance adjustment parameter, $r_N$ represents the video signal adjustment parameter of the Nth row of pixels when the Mth frame image is displayed, $r_1$ and $r_2$ respectively represent two different fixed values, and $r_1$ is greater than $r_2$.

Preferably, in the video signal adjustment method of the display device, the video signal corresponding to the externally input Nth row of pixels when the Mth frame image being displayed is adjusted by the following formula 3, according to the video signal adjustment parameter of the Nth row of pixels when the Mth frame image is displayed.

$$D_{outN}=D_{inN}*r_N \quad \text{[formula 3]}$$

Wherein $D_{outN}$ represents the adjusted video signal corresponding to the Nth row of pixels when the Mth frame image is displayed, $D_{inN}$ represents the video signal corresponding to the externally input Nth row of pixels when the Mth frame image is displayed, and $r_N$ represents the video signal adjustment parameter of the Nth row of pixels when the Mth frame image is displayed.

Preferably, in the video signal adjustment method of the display device, the externally input video signal is converted to a HSV color space to perceive brightness.

Advantageous effects of the present disclosure: The present disclosure adjusts the video signal by controlling the luminance to be displayed by the pixels, thereby controls the luminance of the display device, and controls the aging rate and the costs of the display device. In addition, since the present disclosure controls the luminance to be displayed by the pixel in units of rows, in the adjustment process, only dynamically temporarily store data for each row of pixels, it can greatly save storage space.

BRIEF DESCRIPTION OF THE DRAWINGS

The following description in conjunction with the accompanying drawings, the above and other aspects, features and advantages of the embodiments of the present disclosure will become more apparent from the accompanying drawings in which.

DETAILED DESCRIPTION OF PREFERRED EMBODIMENTS

Hereinafter, the embodiments of the present disclosure will be described in detail with reference to the accompanying diagrams. However, in many different forms and embodiments of the present disclosure, and the disclosure should not be construed as limited to the specific embodiments set forth herein. Rather, these embodiments are provided to explain the principles of the disclosure and its practical application so that others skilled in the art to understand the disclosure for various embodiments and various modifications suited to the particular intended application.

Figure 1:
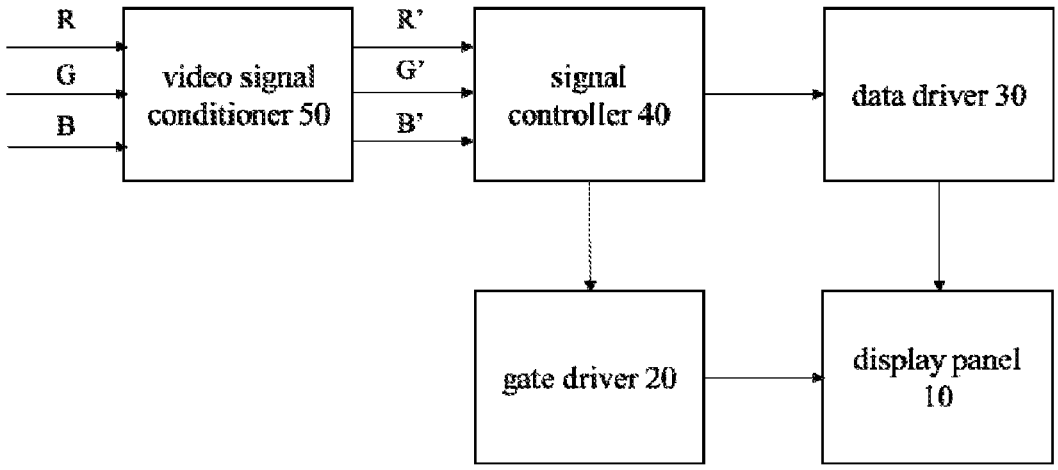
FIG. 1 is a block diagram showing an embodiment of a display device of the present disclosure.

FIG. 1 is a block diagram showing an embodiment of a display device of the present disclosure.

Referring to FIG. 1, a display device according to an embodiment of the present disclosure comprises: a display panel 10, a gate driver 20, a data driver 30, a signal controller 40, and a video signal conditioner 50.

The display panel 10 comprises: a plurality of gate lines (not shown) extending in the row direction, and a plurality of data lines (not shown) extending in the column direction. The gate line is connected to the gate driver 20, and the data line is connected to the data driver 30. The signal controller 40 controls the operation of the gate driver 20 and the data driver 30.

The video signal conditioner 50 receives the input video signal from an external graphics controller (not shown), such as R, B data, and adjusts the input video signal to output the adjusted video data, such as R G B' data. The signal controller 40 receives the adjusted video signal from the video signal conditioner 50 and receives a plurality of input control signals from the external graphics controller for controlling the display of the adjusted video signal. The signal controller 40 processes the adjusted video signal appropriately according to the input control signal, and generates image data conforming to the operating conditions of the display panel 10. Then, the signal controller 40 generates a gate control signal and a data control signal, transfers the gate control signal to the gate driver 20, and transfers the data control signal and the image data to the data driver 30.

The display panel 10 also comprises the pixels (not shown) provided in the region defined by the scanning lines and the data lines, wherein each pixel comprises an OLED.

The gate driver 20 and the data driver 30 are disposed around the display panel 10. The pixels on the display panel 10 display the image according to the analog data signals provided by the data driver 30 and the gate signal provided by the gate driver 20. The analog type data signal provided by the data driver 30 is formed by image data.

The video signal conditioner 50 according to the embodiment of the present disclosure will be described in detail below.

Figure 2:
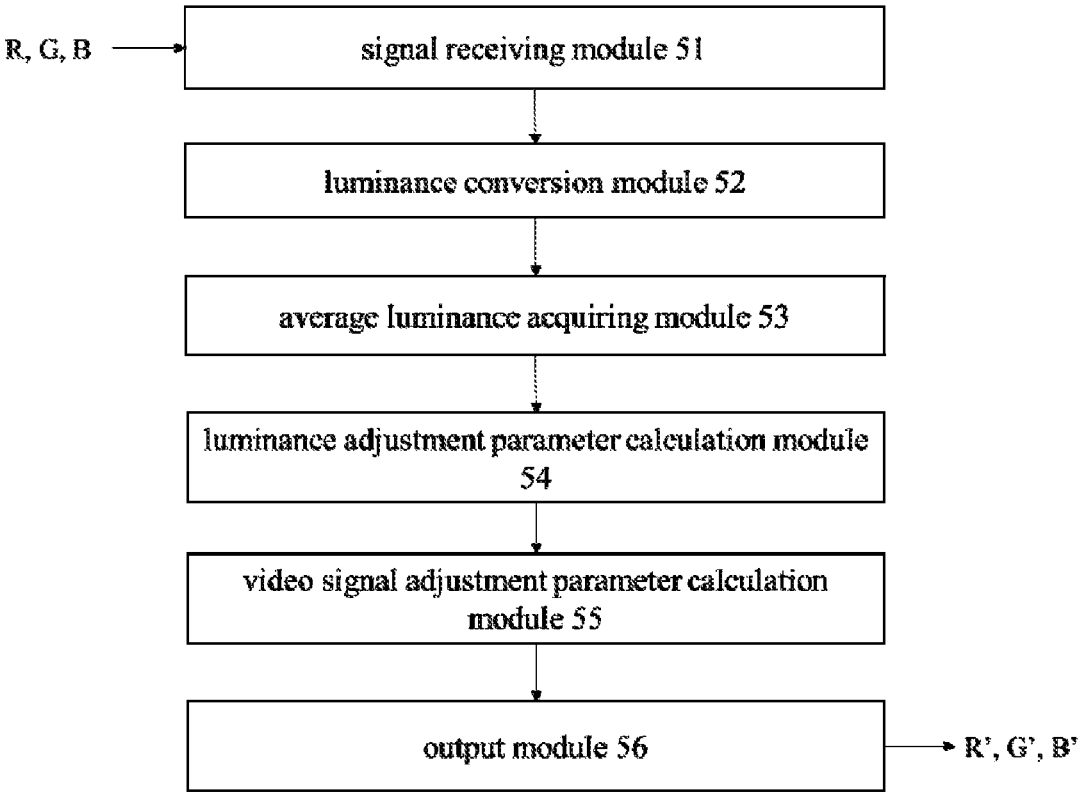
FIG. 2 is a module diagram showing an embodiment of a video signal conditioner of the present disclosure.

FIG. 2 is a module diagram showing an embodiment of the video signal conditioner of the present disclosure.

Referring to FIG. 2, the video signal conditioner 50 according to an embodiment of the present disclosure comprises: a signal receiving module 51, a luminance conversion module 52, an average luminance acquiring module 53, a luminance adjustment parameter calculation module 54, a video signal adjustment parameter calculation module 55, an output module 56.

The signal receiving module 51 for receiving the input video signal from the external graphics controller, such as R, B data. Here, a memory module (not shown) can be configured to store the input video signal. In addition, the input video signal is a video signal supplied to all the pixels.

The luminance conversion module 52 for converting the input video signal to brightness. Further, the luminance conversion module 52 can use the following formula 1 to convert the input video signal to a HSV color space to perceive brightness.

$$h = \begin{cases} 0^\circ, & \text{if } \max = \min \\ 60^\circ \times \dfrac{g-b}{\max-\min} + 0^\circ, & \text{if } \max = r \text{ and } g \geq b \\ 60^\circ \times \dfrac{g-b}{\max-\min} + 360^\circ, & \text{if } \max = r \text{ and } g < b \\ 60^\circ \times \dfrac{b-r}{\max-\min} + 120^\circ, & \text{if } \max = g \\ 60^\circ \times \dfrac{r-g}{\max-\min} + 240^\circ, & \text{if } \max = b \end{cases}, \quad \text{[formula 1]}$$

$$s = \begin{cases} 0, & \text{if } \max = 0 \\ \dfrac{\max-\min}{\max} = 1 - \dfrac{\min}{\max}, & \text{others} \end{cases}$$

$$v = \max$$

Here, max represents the maximum value in r, g, b, min represents the minimum value in r, g, b, h represents the hue of the HSV color space, s represents the saturation of the HSV color space, v represents the luminance of the HSV color space, r represents the input R data, g represents the input G data, and b represents the input B data.

The average luminance acquiring module 53 for acquiring an average luminance of the Nth row of pixels when the Mth frame image is displayed, wherein M and N are positive integers. Here, after the input video signal is converted to the brightness, the average luminance acquiring module 53 can acquire the luminance of each pixel of the Nth row of pixels when the Mth frame image is displayed, and then add the luminance of all the acquired pixels divided by the number of pixels of the Nth row of pixels to obtain the average luminance of the Nth row of pixels when the Mth frame image is displayed.

The luminance adjustment parameter calculation module 54 for calculating a luminance adjustment parameter of the Nth row of pixels when the Mth frame image is displayed according to the average luminance of the Nth row of pixels when the Mth frame image is displayed, the average luminance of the Nth row of pixels when the M−1th frame image is displayed (previously stored in the memory module), and the luminance adjustment parameter of the N−1th row pixel when the Mth frame image is displayed (previously stored in the memory module). Further, the luminance adjustment parameter calculation module 54 uses the following formula 2 to calculate the luminance adjustment parameter of the Nth row of pixels when the Mth frame image is displayed.

$$CL_N = CL_{N-1} + (AL_N - AL'_N)/N \quad \text{[formula 2]}$$

Wherein $AL_N$ represents the average luminance of the Nth row of pixels when the Mth frame image is displayed, $AL'_N$ represents the average luminance of the Nth row of pixels when the M−1th frame image is displayed, $CL_{N-1}$ represents the luminance adjustment parameter of the N−1th row of pixels when the Mth frame image is displayed, and $CL_N$ represents the luminance adjustment parameter of the Nth row of pixels when the Mth frame image is displayed.

The video signal adjustment parameter calculation module 55 for calculating the video signal adjustment parameter of the Nth row of pixels when the Mth frame image is displayed according to the luminance adjustment parameter of the Nth row of pixels when the Mth frame image is displayed, the first preset luminance adjustment parameter, and the second preset luminance adjustment parameter. Further, the video signal adjustment parameter calculation module 55 uses the following formula 3 to calculate the video signal adjustment parameter of the Nth row of pixels when the Mth frame image is displayed.

$$r_N = \begin{cases} r_1 & CL_N \leq CL_{th1} \\ r_1 - \dfrac{(r_1 - r_2)(CL_N - CL_{th1})}{CL_{th2} - CL_{th1}} & CL_{th1} < CL_N \leq CL_{th2} \end{cases} \quad \text{[formula 3]}$$

Wherein $CL_N$ represents the luminance adjustment parameter of the Nth row of pixels when the Mth frame image is displayed, $CL_{th1}$ represents the first preset luminance adjustment parameter, $CL_{th2}$ represents the second preset luminance adjustment parameter, $r_N$ represents the video signal adjustment parameter of the Nth row of pixels when the Mth frame image is displayed, $r_1$ and $r_2$ respectively represent two different fixed values, and $r_1$ is greater than $r_2$.

The output module 56 for adjusting the externally input video signal corresponding to the Nth row of pixels when the Mth frame image is displayed according to the video signal adjustment parameter of the Nth row of pixels when the Mth frame image is displayed, and outputting the adjusted video signal corresponding to the Nth line of pixels when the Mth frame image is displayed. Further, the output module 56 uses the following formula 4 to adjust the externally input video signal corresponding to the Nth row of pixels when the Mth frame image is displayed.

$$D_{outN}=D_{inN}*r_N \quad \text{[formula 4]}$$

Wherein $D_{outN}$ represents the adjusted video signal corresponding to the Nth row of pixels when the Mth frame image is displayed, $D_{inN}$ represents the video signal corresponding to the externally input Nth row of pixels when the Mth frame image is displayed, and $r_N$ represents the video signal adjustment parameter of the Nth row of pixels when the Mth frame image is displayed. Here, $D_{inN}$ comprises the externally input R data, G data, and B data corresponding to the Nth row of pixels when the Mth frame image is displayed. $D_{outN}$ comprises the adjusted R' data, G' data, and B' data corresponding to the Nth row of pixels when the Mth frame image is displayed.

As above, the video signal of each row of pixels can be adjusted according to the luminance of each pixel to adjust the input video signal such as R data, G data and B data to the adjusted video data such as R' data, G' data and B' data.

In summary, the video signal can be adjusted by controlling the luminance to be displayed by the pixels, thereby controls the luminance of the display device, so as controls the aging rate and the cost of the display device. In addition, since the present embodiment controls the luminance to be displayed by the pixel in units of rows, in the adjustment process, only dynamically temporarily store data for each row of pixels, it can greatly save storage space.

Figure 3:
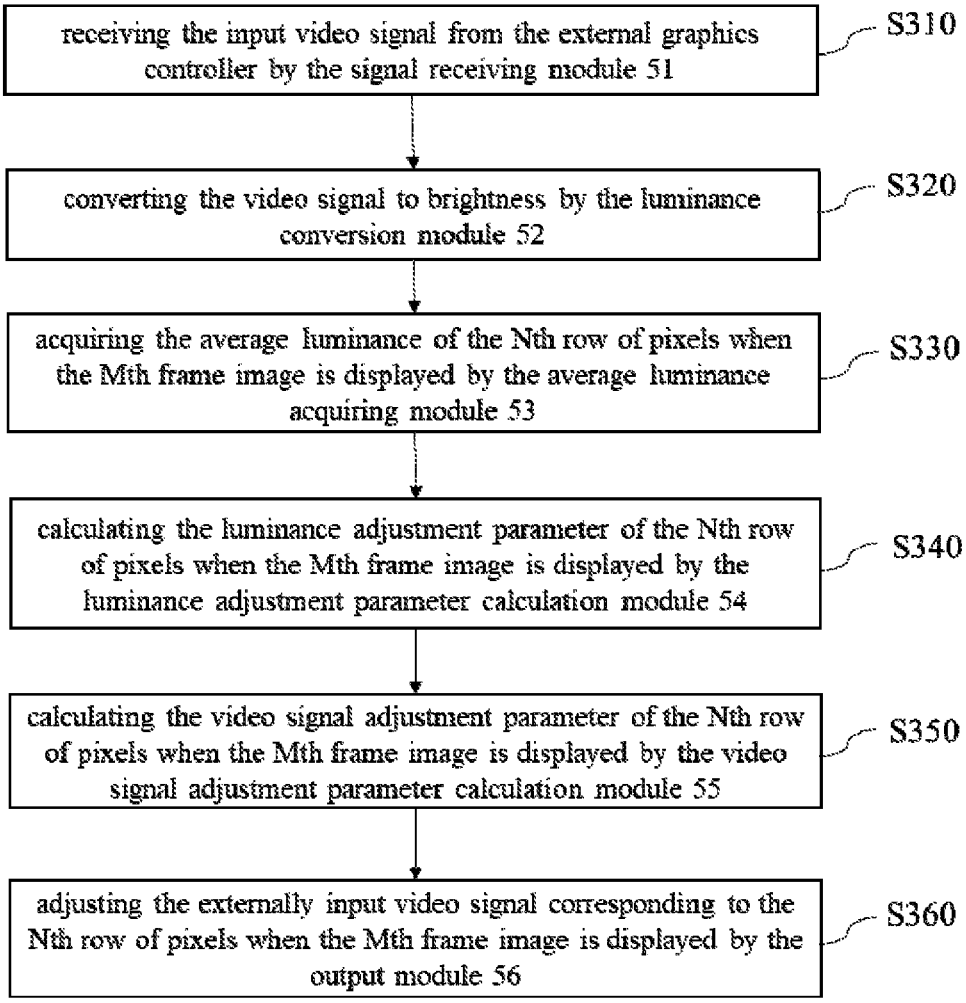
FIG. 3 is a flow diagram showing an embodiment of a video signal adjustment method of the present disclosure.

FIG. 3 is a flow diagram showing an embodiment of a video signal adjustment method of the present disclosure.

Referring to FIG. 2 and FIG. 3, the embodiment of the video signal adjustment method of the present disclosure comprises the steps of:

S310: receiving the input video signal from the external graphics controller by the signal receiving module 51, such as R, B data. Here, a memory module (not shown) can be configured to store the input video signal. In addition, the input video signal comprises a video signal supplied to all the pixels.

S320: converting the video signal to brightness by the luminance conversion module 52.

Further, in step S320, the luminance conversion module 52 can convert the input video signal to the HSV color space to perceive brightness by the above formula 1.

S330: acquiring the average luminance of the Nth row of pixels when the Mth frame image is displayed by the average luminance acquiring module 53, wherein the M and N are both positive integers, and $1 \leq N \leq n$.

Further, in step S330, after the input video signal is converted to the brightness, the average luminance acquisition module 53 can acquire the luminance of each pixel of the Nth row of pixels when the Mth frame image is displayed, and then add the luminance of all the acquired pixels divided by the number of pixels of the Nth row of pixels to obtain the average luminance of the Nth row of pixels when the Mth frame image is displayed.

S340: calculating the luminance adjustment parameter of the Nth row of pixels when the Mth frame image is displayed according to the average luminance of the Nth row of pixels when the Mth frame image is displayed, the average luminance of the Nth row of pixels when the M−1th frame image is displayed, and the luminance adjustment parameter of the N−1th row pixel when the Mth frame image is displayed by the luminance adjustment parameter calculation module 54.

Further, in step S340, the luminance adjustment parameter calculation module 54 calculates the luminance adjustment parameter of the Nth row of pixels when the Mth frame image is displayed by the above formula 2.

S350: calculating the video signal adjustment parameter of the Nth row of pixels when the Mth frame image is displayed according to the luminance adjustment parameter of the Nth row of pixels when the Mth frame image is displayed, a first preset luminance adjustment parameter, and a second preset luminance adjustment parameter by the video signal adjustment parameter calculation module 55.

Further, in step S350, the video signal adjustment parameter calculation module 55 calculates the video signal adjustment parameter of the Nth row of pixels when the Mth frame image is displayed by the above formula 3.

S360: adjusting the externally input video signal corresponding to the Nth row of pixels when the Mth frame image is displayed according to the video signal adjustment parameter of the Nth row of pixels when the Mth frame image is displayed, and outputting the adjusted video signal corresponding to the Nth line of pixels when the M frame image is displayed by the output module 56.

Further, in step S360, the output module 56 adjusts the externally input video signal corresponding to the Nth row of pixels when the Mth frame image is displayed by the above formula 4.

As above, the video signal of each row of pixels can be adjusted according to the brightness of each pixel to adjust the input video signal such as R data, G data and B data to the adjusted video data such as R' data, G' data and B' data.

In addition, according to the present application is a reference to a method and apparatus (system) of the present application will be described in the embodiment. It should be understood that the computer program instructions can be combined to achieve information sensing device, and the combination of the flowchart and/or block diagram each process and/or blocks in the flowchart and/or block diagram of the process and/or box. These computer program instructions may be provided to a general-purpose computer, special purpose computer, embedded processor or other programmable data processing apparatus to produce a machine, such that the instructions executed by a computer or other programmable data processing apparatus with information sensing device generating apparatus for implementing a process flow diagram or more processes and/or block diagram block or blocks a specified function.

In addition, according to an embodiment of the present invention, the picture compression device individual modules or units may be implemented as hardware components. Those skilled in the individual modules or units in accordance with the processing performed by defined, may be used, for example a field programmable gate array (FPGA) or application specific integrated circuit (ASIC) to implement various modules or units.

Although reference to particular embodiments shown and described the present disclosure, those skilled in the art will understand: without departing from the spirit and scope of the appended claims and their equivalents of the present invention case, in the various changes in form and details.

What is claimed is:

1. A video signal adjustment method of a display device, wherein the video signal adjustment method comprises:

receiving an externally input video signal;

converting the externally input video signal to brightness;

acquiring an average luminance of a Nth row of pixels when the Mth frame image is displayed;

calculating a luminance adjustment parameter of the Nth row of pixels when the Mth frame image is displayed, according to the average luminance of the Nth row of pixels when the Mth frame image is displayed, the average luminance of the Nth row of pixels when a M−1th frame image is displayed, and the luminance adjustment parameter of a N−1th row pixel when the Mth frame image is displayed;

calculating a video signal adjustment parameter of the Nth row of pixels when the Mth frame image is displayed, according to the luminance adjustment parameter of the Nth row of pixels when the Mth frame image is displayed, a first preset luminance adjustment parameter, and a second preset luminance adjustment parameter;

adjusting an externally input video signal corresponding to the Nth row of pixels when the Mth frame image is displayed according to the video signal adjustment parameter of the Nth row of pixels when the Mth frame image is displayed, and outputting the adjusted video signal corresponding to the Nth row of pixels when the M frame image is displayed; wherein the luminance adjustment parameter of the Nth row of pixels when the Mth frame image being displayed is calculated by a following formula 1, according to the average luminance of the Nth row of pixels when the Mth frame image is displayed, the average luminance of the Nth row of pixels when the M−1th frame image is displayed, and the luminance adjustment parameter of a N−1th row pixel when the Mth frame image is displayed, $$CL_N=CL_{N-1}+(AL_N-AL'_N)/N \quad \text{[formula 1]}$$

wherein $AL_N$ represents the average luminance of the Nth row of pixels when the Mth frame image is displayed, $AL'_N$ represents the average luminance of the Nth row of pixels when the M−1th frame image is displayed, $CL_{N-1}$ represents the luminance adjustment parameter of the N−1th row of pixels when the Mth frame image is displayed, and $CL_N$ represents the luminance adjustment parameter of the Nth row of pixels when the Mth frame image is displayed.

2. The video signal adjustment method according to claim 1, wherein the video signal corresponding to the externally input Nth row of pixels when the Mth frame image being displayed is adjusted by a following formula 2, according to the video signal adjustment parameter of the Nth row of pixels when the Mth frame image is displayed, $$D_{outN}=D_{inN}*r_N \quad \text{[formula 2]}$$

wherein $D_{outN}$ represents the adjusted video signal corresponding to the Nth row of pixels when the Mth frame image is displayed, $D_{inN}$ represents the video signal corresponding to the externally input Nth row of pixels when the Mth frame image is displayed, and $r_N$ represents the video signal adjustment parameter of the Nth row of pixels when the Mth frame image is displayed.

3. The video signal adjustment method according to claim 1, wherein the externally input video signal is converted to a HSV color space to perceive brightness.

4. A video signal adjustment method of a display device, wherein the video signal adjustment method comprises:

receiving an externally input video signal;

converting the externally input video signal to brightness;

acquiring an average luminance of a Nth row of pixels when the Mth frame image is displayed;

calculating a luminance adjustment parameter of the Nth row of pixels when the Mth frame image is displayed, according to the average luminance of the Nth row of pixels when the Mth frame image is displayed, the average luminance of the Nth row of pixels when a M−1th frame image is displayed, and the luminance adjustment parameter of a N−1th row pixel when the Mth frame image is displayed;

calculating a video signal adjustment parameter of the Nth row of pixels when the Mth frame image is displayed, according to the luminance adjustment parameter of the Nth row of pixels when the Mth frame image is displayed, a first preset luminance adjustment parameter, and a second preset luminance adjustment parameter;

adjusting an externally input video signal corresponding to the Nth row of pixels when the Mth frame image is displayed according to the video signal adjustment parameter of the Nth row of pixels when the Mth frame image is displayed, and outputting the adjusted video signal corresponding to the Nth row of pixels when the M frame image is displayed; wherein the video signal adjustment parameter of the Nth row of pixels when the Mth frame image being displayed is calculated by a following formula 1, according to the luminance adjustment parameter of the Nth row of pixels when the Mth frame image is displayed, a first preset luminance adjustment parameter, and a second preset luminance adjustment parameter, $$r_N=\begin{cases} r_1 & CL_N \le CL_{th1} \\ r_1-\dfrac{(r_1-r_2)(CL_N-CL_{th1})}{CL_{th2}-CL_{th1}} & CL_{th1}<CL_N \le CL_{th2} \end{cases} \quad \text{[formula 1]}$$

wherein $CL_N$ represents the luminance adjustment parameter of the Nth row of pixels when the Mth frame image is displayed, $CL_{th1}$ represents the first preset luminance adjustment parameter, $CL_{th2}$ represents the second preset luminance adjustment parameter, $r_N$ represents the video signal adjustment parameter of the Nth row of pixels when the Mth frame image is displayed, $r_1$ and $r_2$ respectively represent two different fixed values, and $r_1$ is greater than $r_2$.

5. The video signal adjustment method according to claim 4, wherein the video signal corresponding to the externally input Nth row of pixels when the Mth frame image being displayed is adjusted by a following formula 2, according to the video signal adjustment parameter of the Nth row of pixels when the Mth frame image is displayed, $$D_{outN}=D_{inN}*r_N \quad \text{[formula 2]}$$

wherein $D_{outN}$ represents the adjusted video signal corresponding to the Nth row of pixels when the Mth frame image is displayed, $D_{inN}$ represents the video signal corresponding to the externally input Nth row of pixels when the Mth frame image is displayed, and $r_N$ represents the video signal adjustment parameter of the Nth row of pixels when the Mth frame image is displayed.

6. The video signal adjustment method according to claim 4, wherein the externally input video signal is converted to a HSV color space to perceive brightness.

* * * * *